US007497898B2

(12) United States Patent
Sato et al.

(10) Patent No.: US 7,497,898 B2
(45) Date of Patent: Mar. 3, 2009

(54) IONIZER

(75) Inventors: Toshio Sato, Tsukubamirai (JP); Satoshi Suzuki, Tsukubamirai (JP); Takashi Yasuoka, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 11/877,269

(22) Filed: Oct. 23, 2007

(65) Prior Publication Data

US 2008/0098895 A1 May 1, 2008

(30) Foreign Application Priority Data

Oct. 31, 2006 (JP) ..... 2006-296446

(51) Int. Cl.
*B03C 3/80* (2006.01)

(52) U.S. Cl. ..... 96/43; 96/50; 96/84; 96/95; 96/97; 313/230; 313/238; 361/225

(58) Field of Classification Search ..... 96/95, 96/97, 83, 84, 43, 50, 55, 58, 18–24; 313/230, 313/238, 243, 293; 361/225–235
See application file for complete search history.

(56) References Cited

U.S. PATENT DOCUMENTS

| | | | | | |
|---|---|---|---|---|---|
| 1,995,790 | A | * | 3/1935 | Anderson | 96/64 |
| 2,209,798 | A | * | 7/1940 | Subkow | 208/350 |
| 2,381,578 | A | * | 8/1945 | Dillon et al. | 95/57 |
| 3,156,847 | A | * | 11/1964 | Schweriner | 361/230 |
| 3,195,819 | A | * | 7/1965 | Watanabe | 239/601 |
| 3,206,625 | A | * | 9/1965 | Stuetzer | 310/309 |
| 3,476,095 | A | * | 11/1969 | De Laubarede | 123/536 |
| 3,768,258 | A | * | 10/1973 | Smith et al. | 60/275 |
| 3,879,986 | A | * | 4/1975 | Sehmel | 73/28.04 |
| 3,957,374 | A | * | 5/1976 | Kriese et al. | 356/312 |
| 4,391,614 | A | * | 7/1983 | Rozmus | 95/28 |
| 4,477,263 | A | * | 10/1984 | Shaver et al. | 95/7 |
| 4,741,746 | A | * | 5/1988 | Chao et al. | 96/43 |
| 5,667,563 | A | * | 9/1997 | Silva, Jr. | 96/50 |

(Continued)

FOREIGN PATENT DOCUMENTS

| | | | | | |
|---|---|---|---|---|---|
| JP | 56-78645 | A | * | 6/1981 | 96/97 |

(Continued)

OTHER PUBLICATIONS

U.S. Appl. No. 11/877,269, filed Oct. 23, 2007, Sato et al.

(Continued)

*Primary Examiner*—Richard L Chiesa
(74) *Attorney, Agent, or Firm*—Oblon, Spivak, McClelland, Maier & Neustadt, P.C.

(57) ABSTRACT

Positive and negative electrode needles, an air-blowing outlet, and a protection cover for covering these electrode needles and the air-blowing outlet are attached to an electrode cartridge which is attached to a housing, and an air-blowing hole positioned in front of the air-blowing outlet in a concentric manner therewith, for blowing out air from the air-blowing outlet toward the outside, and two air-flowing-out holes positioned in a concentric manner with the respective positive and negative electrode needles, and respectively surrounding outer peripheries of respective tip end portions of respective electrode needles via respective gaps for flowing out the air are formed in the protection cover.

13 Claims, 6 Drawing Sheets

U.S. PATENT DOCUMENTS

| | | | | |
|---|---|---|---|---|
| 6,464,754 | B1 * | 10/2002 | Ford | 95/26 |
| 6,506,232 | B2 * | 1/2003 | Menear | 95/59 |
| 7,115,153 | B2 * | 10/2006 | Ahlborn et al. | 95/74 |
| 2006/0278081 | A1 * | 12/2006 | Han et al. | 96/61 |
| 2007/0126363 | A1 | 6/2007 | Sato et al. | |

FOREIGN PATENT DOCUMENTS

| | | |
|---|---|---|
| JP | 2005-108829 | 4/2005 |

OTHER PUBLICATIONS

U.S. Appl. No. 12/015,010, filed Jan. 16, 2008, Sato et al.

* cited by examiner

IONIZER

TECHNICAL FIELD

The present invention relates to an ionizer used for discharging various kinds of electrostatically charged workpieces, and more in detail, to an ionizer provided with a function for preventing an electrode needle from fouling due to adhesion of dust.

BACKGROUND ART

In a treating process for various types of workpieces such as a semiconductor wafer, liquid crystal glass, and so forth, an ionizer is used for discharging the workpiece, which is electrostatically charged. The ionizer is constructed, as described in, for example, Japanese Unexamined Patent Application Publication No. 2005-108829, such that a positive electrode needle and a negative electrode needle are disposed in parallel with each other in an electrode-attaching opening at a lower surface of a housing, and that positive and negative ions are alternately generated by generating a corona discharge at both the electrode needles by means of alternately applying a positive pulsing high voltage and a negative pulsing high voltage to these electrode needles.

Further, an air-blowing outlet is opened at a position between the positive and negative electrode needles, and air is blown out from the air-blowing outlet. Thereby, the ion generated by the electrode needles is brought in, and thereby the air is ionized and blown to the workpiece.

In this kind of ionizer, the positive and negative electrode needles tend to foul by adhesion of dust in the air, and when the fouling operation proceeds, a generating amount of the ion is being reduced because of the generation of the corona discharge gradually becomes difficult. Therefore, there is a possibility that the generation of the ions is finally stopped. Therefore, this requires frequent maintenance such as a cleaning operation, an exchanging operation, and so forth for the foul electrode needle, and during the time when the maintenance is performed, operations of the ionizer and related facilities have to be stopped. Consequently, there has been a problem such as that an operating efficiency tends to be lowered while taking trouble and wasting time.

DISCLOSURE OF INVENTION

It is an object of the present invention to provide an ionizer provided with a function for suppressing adhesion of dust to an electrode needle and capable of easily removing the dirt even when an electrode needle gets fouled so as to solve the above-described hitherto known problems.

In order to achieve the object, the ionizer according to the present invention is characterized in including a housing including one of more electrode-attaching portions, positive and negative electrode needles disposed in the electrode-attaching portions, respectively, in parallel with each other for generating an ion, an air-blowing outlet being open in the electrode-attaching portion at a position between both the positive and negative electrode needle, a protection cover for covering both the positive and negative electrode needles, and the air-blowing outlet, and a spatial portion spreading inside the protection cover across both of the positive and negative electrode needles, and the air-blowing outlet, in which the protection cover includes an air-blowing hole, and two air-flowing-out holes, and in which the air-blowing hole is positioned in front of the air-blowing outlet for blowing air blown out from the air-blowing outlet toward a workpiece, and the air-flowing-out holes are respectively formed at positions corresponding to the positive and negative electrode needles, and allow the air blown out from the air-flowing outlet and diffused in the spatial portion, to flow out to an outside of the protection cover along the positive and negative electrode needles, respectively.

In the present invention, preferably, the positive and negative electrode needles are attached to the electrode cartridge, and the positive and negative electrode needles are attached to the electrode-attaching portion of the housing via the electrode cartridge, and in which the electrode cartridge includes a concave portion encompassing the tip end portion of each of the positive and negative electrode needles, and in which the air-blowing outlet is opened in the concave portion and the protection cover is disposed in a manner so as to cover the air-blowing outlet and both the positive and negative electrode needles.

In the present invention, preferably, the air-blowing hole is concentrically positioned with the air-blowing outlet, and the air-flowing-out hole is concentrically positioned with the positive and negative electrode needles. Further, preferably, an acute tip end portion of each of the positive and negative electrode needles projects out from the air-flowing-out hole in front of the protection cover. Furthermore, preferably, a hole diameter of the air-blowing hole is smaller than a hole diameter of the air-flowing-out hole.

In the ionizer according to the present invention, it is preferable that an electrode cartridge is constructed by detachably attaching a back plate provided with the positive and negative electrode needles to a sheath cartridge being detachable to the housing, and that the concave portion is formed in the sheath cartridge, and that a tip end portion of the electrode needle attached to the back plate is projected to the concave portion through a holding hole for use in the electrode needle in the sheath cartridge. In the case, the air-blowing outlet may be formed in a nozzle member and the nozzle member may be inserted into a center of the electrode cartridge whose plane shape is a long circle. Further, it is preferable that the back plate is provided with a pair of sandwiching pieces for fixing the back plate to the sheath cartridge by means of sandwiching the sheath cartridge, and that at least one of the sandwiching pieces is constructed to be the one which elastically sandwiches the sheath cartridge by means of the elasticity of a thin-walled elastic deformation portion. It is also preferable that the electrode needle is non-rotatably and non-detachably mounted on the back plate.

In the present invention, in a case that the nozzle member is inserted into the center of the electrode cartridge, it is preferable that the electrode cartridge is attached to the housing to have a following construction.

That is, an electrode-attaching hole for attaching the electrode cartridge to be provided in the housing corresponds to the plane shape of the electrode cartridge, and in addition, the electrode cartridge being fitted into the electrode attaching hole is formed as that having a plane shape including a room where the electrode cartridge can be slanted around the nozzle member in the electrode-attaching hole. It is preferable that a latch mechanism is provided in the electrode cartridge 43 and the electrode-attaching hole 47. The latch mechanism is that the electrode cartridge 43 latches and fixes into the electrode-attaching hole 47 when the electrode cartridge is in a normally attached state after fitting the electrode cartridge into the electrode-attaching hole at a position of the room 47*a*. On the other hand, the latch mechanism allows the electrode cartridge 43 to remove from the electrode-attaching hole in a condition that the electrode cartridge 43 slants within the room 47*a*.

The latch mechanism has a structure that a latch projection at an upper part, and a friction ridge at a lower part thereof, which has a projecting height smaller than that of the latch projection are provided at both end portions in a longitudinal direction of the electrode cartridge. Side grooves that pass the latch projection when the electrode cartridge is fitted into the electrode-attaching hole in a slanted condition within the room are provided at both end portions in a longitudinal direction of the electrode-attaching hole. Further, adjoining the side groove, an elastic contacting piece that elastically comes in contact with the friction ridge when the electrode cartridge is returned to a normally attached state along a longitudinal direction of the housing after fitting the same into the electrode-attaching hole is provided. The elastic contacting piece is constructed as the one that elastically comes in contact with the friction ridge by that the electrode cartridge is pressed by the friction ridge when the electrode cartridge being in a slanted state is returned to the normally attached state while rotating the same. Both the elastic contacting pieces suppress a dropping-off operation of the electrode cartridge by means of being latched with the latch projection while being positioned at a lower part of the latch projection at both ends of the electrode cartridge being returned to the normally attached state. Thereby, the electrode cartridge is detachably fixed.

For an electric connection of the high voltage generating apparatus of the housing and the electrode cartridge, it is preferable that a connecting terminal connected to the positive and negative high voltages generating circuit in the high voltage generating apparatus in the housing is provided in the electrode attaching portion of the housing where the electrode cartridge is attached, and that these connecting terminals are provided at a position corresponding to the electrode needle of the electrode cartridge to be mounted on the electrode attaching portion. Further, the sheath cartridge can be composed of a cartridge body having an approximately long circle in plane shape, and a protection cover having the same shape and configured to be detachably coupled while engaging a flange portion and a latch groove thereof by sliding the cartridge body and the protection cover in a longitudinal direction thereof.

In the ionizer according to the present invention, when the positive pulsing high-voltage and the negative pulsing high-voltage are alternately applied to the positive and negative electrode needles, respectively, the positive and negative ions are alternately generated by means of the corona discharge from both the electrode needles. Currently, the air is blown out from the air-blowing outlet into the spatial portion and thereby the air is blown toward the workpiece from the air-blowing hole being open in the protection cover, and currently the air becomes ionized air by bringing in the ions generated from the electrode needles, and a discharging operation for the workpiece is performed by means of the ions.

On the other hand, a part of the air blown out from the air-blowing outlet is diffused in the spatial portion, and flows out toward outside from the air-flowing-out hole surrounding a periphery of the electrode needle. The flow of the air sweeps away dust such as dirt or the like existing in the air on a surface of or around the electrode needles, and prevents the dust from adhering to the surface of the electrode needles as the dirt. Hence, the dirt of the electrode needles due to adhesion of the dust is reduced, and a frequency of maintenance such as the cleaning for and exchanging of the electrode needles is reduced.

As described above, if the electrode cartridge is configured to be detachable from the housing, and the back plate provided with the electrode needle is configured to be removed at the same time, it becomes possible to exchange the electrode needles or remove the dirt from the outside with ease.

BEST MODE FOR CARRYING OUT THE INVENTION

Figure 1:
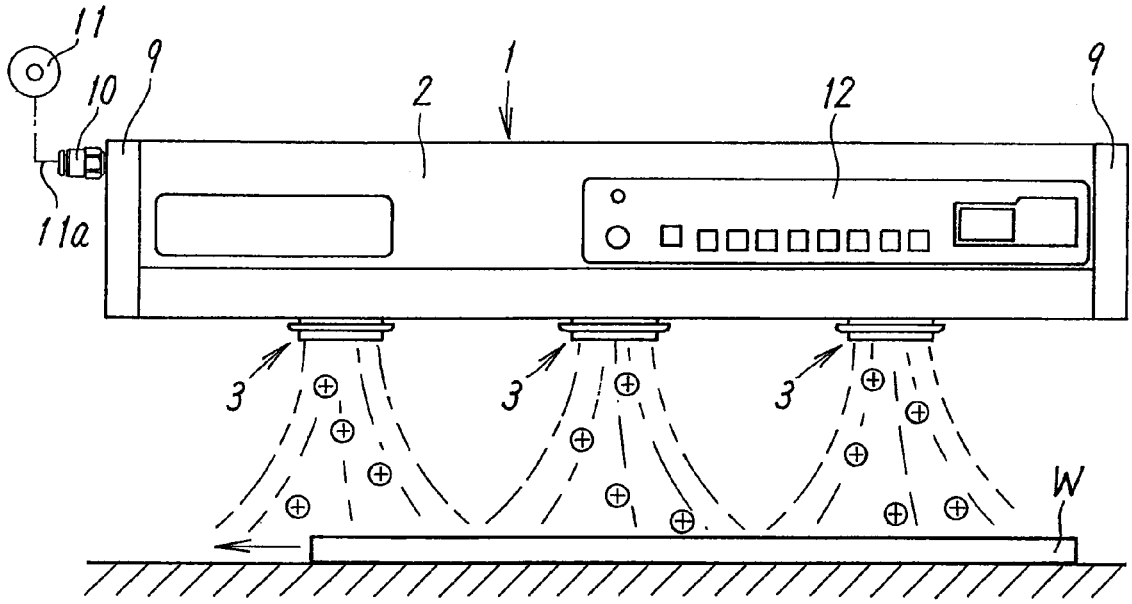
FIG. 1 is a front view illustrating a first embodiment of an ionizer according to the present invention.

FIG. 1 through FIG. 4 illustrate an embodiment of an ionizer according to the present invention. This ionizer 1 is used for discharging the workpiece which is electrostatically charged in a treating process for various types of workpieces such as a semiconductor wafer, liquid crystal glass, and so forth, and as illustrated in FIG. 1, when positive and negative ions are alternately applied from this ionizer 1 to a workpiece W, and in a case that the workpiece W is charged to be positive, a negative ion is absorbed by the workpiece W, and in a case that the workpiece W is charged to be negative, a positive ion is absorbed by the workpiece W. Thus, the workpiece W is discharged. Incidentally, although a moment when the positive ion is applied is illustrated in FIG. 1, the negative ion is successively applied thereafter in a similar manner as that mentioned above.

The ionizer 1 is a bar-type ionizer having a thin long rod shape, and provided with a laterally thin long hollow housing 2. A cross-sectional shape in a longitudinal direction of the housing 2 is any one of a rectangular shape elongated in an up-and-down direction, a long circle, or shapes similar thereto.

Figure 2:
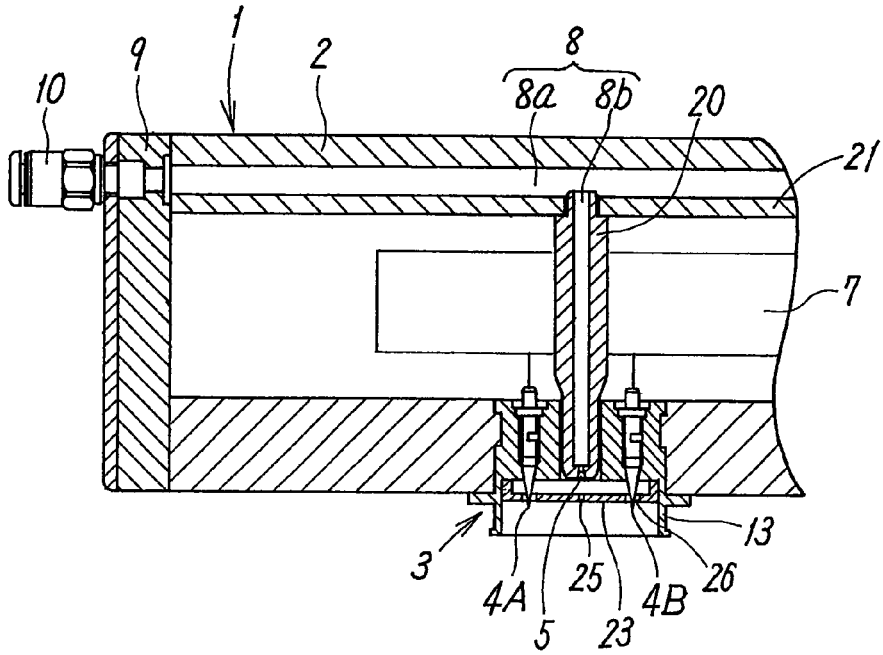
FIG. 2 is a partially enlarged view of FIG. 1.
Figure 3:
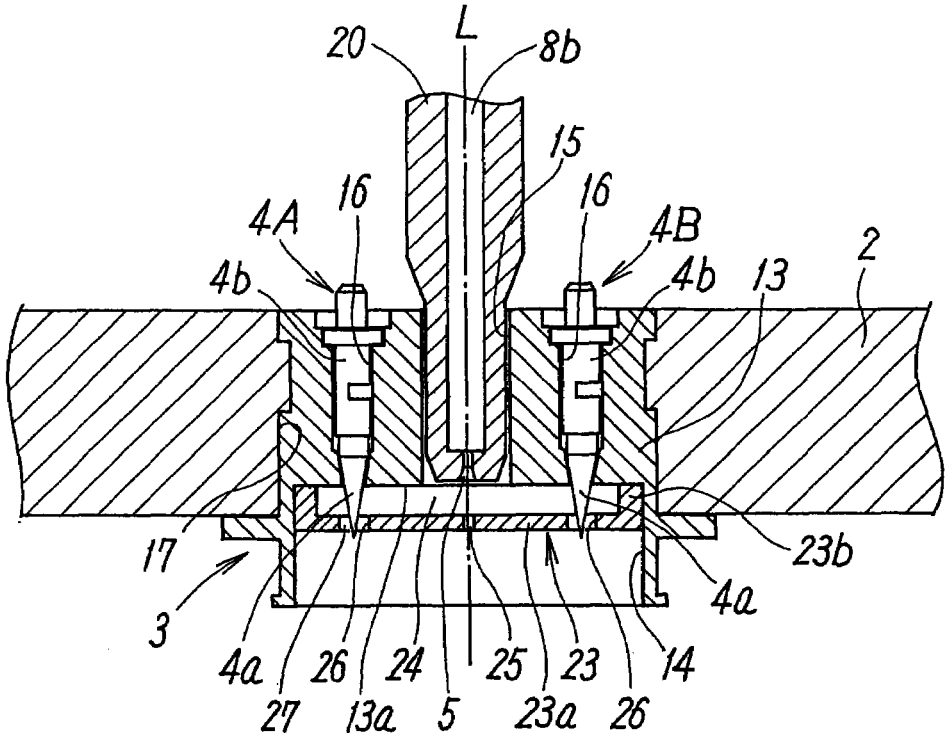
FIG. 3 is a further partially enlarged view of FIG. 2.
Figure 4:
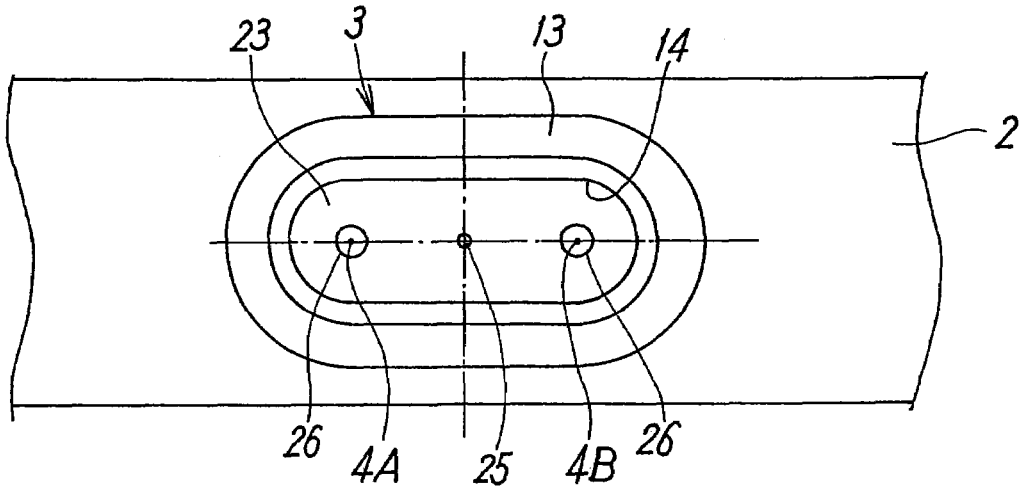
FIG. 4 is a bottom view of FIG. 3.

At a lower surface of the housing 2, a plurality of electrode-attaching portions 3 are provided in the longitudinal direction of the housing 2 at even intervals, and a pair of positive electrode needle 4A that discharges positive ion, and negative electrode needle 4B that discharges negative ion, by means of a corona discharge are attached at each of the electrode-attaching portions 3, and an air-blowing outlet 5 for blowing the discharged ions toward the workpiece W is provided at each of the electrode-attaching portions 3, as is clear from FIG. 2 through FIG. 4.

Further, at an inner part of the housing 2, a high-voltage-generating device 7 for applying pulsing high voltage of direct electric current to the electrode needles 4A and 4B, and an air flow path 8 for supplying compressed air into the air-blowing outlet 5 are provided.

Both end portions in the longitudinal direction of the housing 2 are respectively closed by end plates 9, and a joint 10 is provided on one or both of the end plates 9. The air flow path 8 is configured to be connected to a compressed air source 11 by connecting piping tube 11*a* from the compressed air source 11 to the joint 10.

At a side face of the housing 2, an operation display portion 12 is formed, and operation buttons, display lamps, and so forth are attached thereto.

The high-voltage-generating device 7 are provided with, though not specifically illustrated, a positive high voltage-generating circuit for applying a positive pulsing high voltage to the positive electrode needle 4A, and a negative high voltage-generating circuit for applying a negative pulsing high voltage to the negative electrode needle 4B. The positive and negative ions are generated by generating the corona discharge at the electrode needles 4A and 4B, by means of alternately applying the positive and negative high voltages from these high voltage-generating circuits operating in a periodic manner to both the electrode needles 4A and 4B. Incidentally, the positive and negative high voltages generating circuit may be configured to simultaneously apply the positive and negative high voltages to the positive and negative electrode needle.

The electrode needles 4A and 4B are respectively provided with a column-shaped base end portion 4*b* for attaching, and a conical tip end portion 4*a* for corona discharge, and are attached to the respective electrode-attaching portions 3 via an electrode cartridge 13 formed of an electric insulating non-magnetizable material such as synthetic resin or the like. The electrode cartridge 13 has a shape of approximately long circle in lateral cross-section and is provided with a concave portion 14 having a shape of approximately long circle, at a front surface (lower surface) thereof, as is clear from FIG. 3 and FIG. 4. In an inner bottom wall 13*a* of the concave portion 14, a nozzle-attaching hole 15 is formed at a center portion thereof, namely at a position on a center axis line L of the electrode cartridge 13, and two holding holes 16 for holding the electrode needles are formed at positions apart from the center axis line L at even distances in a length direction (long axis direction) of the long circle. By fitting the base end portion 4*b* of each of the electrode needles 4A and 4B into each of these holding holes 16 and 16, two electrode needles 4A and 4B are attached to the electrode cartridge 13 in parallel with each other in a condition where acute tip end portions 4*a* and 4*a* project out in the concave portion 14. A length of the tip end portion 4*a* of each of the electrode needles 4A and 4B projecting outward from the inner bottom wall 13*a* of the concave portion 14 is smaller than a depth of the concave portion 14. Hence, there is no possibility that the tip end portion 4*a* of each of the electrode needles 4A and 4B projects outward from the concave portion 14, and the same is in a state of being encompassed inside the concave portion 14.

Further, the electrode cartridge 13 is fitted into an attaching hole 17 of a long circle in shape formed at the lower surface of the housing 2 and fixed thereto. Thereby, the electrode cartridge 13 is attached to the housing 2 in a state of directing a long axis of the long circle thereof toward the longitudinal direction of the housing 2. Hence, this means that the two of the positive and negative electrode needles 4A and 4B are also disposed along the longitudinal direction of the housing 2.

The electrode cartridge 13 can be fixed to the housing 2 by a method, for example, in which a projection and a concave portion respectively formed on one and the other of these electrode cartridge 13 and the housing 2 are engaged with each other, or a method of a supersonic welding or the like.

Furthermore, in the nozzle-attaching hole 15 of the electrode cartridge 13, a nozzle member 20 provided with the air-blowing outlet 5 at a tip end thereof is inserted, and the air-blowing outlet 5 is formed at a position on the center axis line L of the inner bottom wall 13*a* of the concave portion 14 via the nozzle member 20. A base end portion of this nozzle member 20 is coupled with a flow path forming portion 21 extending in an inner part of the housing 2 in a longitudinal direction thereof, and a branch flow path 8*b* that connects a main flow path 8*a* in the flow path forming portion 21 and the air-blowing outlet 5 is formed in an inner part of the nozzle member 20. The air flow path 8 is formed with the main flow path 8*a* and the branch flow path 8*b*.

A size of a cross-section area of the main flow path 8*a* and that of the branch flow path 8*b* are approximately the same to each other, and an opening cross-section area of the air-blowing outlet 5 is formed smaller than each of cross-section areas of the main flow path 8*a* and the branch flow path 8*b*. Thereby, the air sent from the air flow path 8 having a relatively large diameter is configured to vigorously blow out at high speed from the air-blowing outlet 5 that is narrowed down.

The air-blowing outlet 5 may directly be formed at the inner bottom wall 13*a*.

A protection cover 23 for covering both of the electrode needles 4A and 4B, and the air-blowing outlet 5 is disposed in an inner part of the concave portion 14 of the electrode cartridge 13. The protection cover 23 is formed of an electric insulating non-magnetizable material such as synthetic resin or the like, and is provided with a flat plate-shaped body portion 23*a* spread over the entire concave portion 14, and a flange-shaped outer peripheral wall 23*b* perpendicularly extending in relation to the body portion 23*a* from an outer periphery of the body portion 23*a*. The protection cover 23 is formed of a shallow plate shape as a whole, and a spatial portion 24 spread over the entire concave portion 14 is formed between the body portion 23*a* and the inner bottom wall 13*a* of the concave portion 14 by that the outer peripheral wall 23*b* is brought into contact with the inner bottom wall 13*a* of the concave portion 14. Preferably, the protection cover 23 is detachably attached to the electrode cartridge 13 by a device such as screwing, adhesion, or the like.

At the body portion 23*a* of the protection cover 23, an air-blowing hole 25 for blowing the air that is blown out from the air-blowing outlet 5 to the workpiece is formed in a manner so as to be positioned in front of the air-blowing outlet 5. Moreover, two air-flowing-out holes 26 and 26 for exposing the tip end portions 4*a* and 4*a* of the positive and negative electrode needles 4A and 4B, respectively, to an outside, and for allowing the air blown out from the air-blowing outlet 5 and diffused in the spatial portion 24 to flow out to an outside of the protection cover 23 along the positive and negative electrode needles 4A and 4B, respectively, are formed one in number at each of the positions corresponding to the positive and negative electrode needles 4A and 4B, respectively.

The air-blowing hole 25 is disposed at a position just before the air-blowing outlet 5 in a manner concentric with the air-blowing outlet 5, and the same is formed to have approximately the same diameter as that of the air-blowing outlet 5. However, the position is not necessary to be perfectly concentric with that of the air-blowing outlet 5, and the diameter of the air-blowing hole 25 is not necessary to be perfectly the same as that of the air-blowing outlet 5. The position of the air-blowing hole 25 may be the position slightly deviated from a center of the air-blowing outlet 5, as long as the position is, for example, within a jet flow area of the air blown out from the air-blowing outlet 5, namely, the position where the jet flow of the air blown out from the air-blowing outlet 5 is directly blown. Further, the air-blowing hole 25 may have a diameter slightly larger than or slightly smaller than that of the air-blowing outlet 5.

On the other hand, the air-flowing-out holes 26 and 26 are concentrically positioned with the electrode needles 4A and 4B, respectively, and the acute tip end portion 4*a* of each of the electrode needles 4A and 4B slightly projects outward from the air-flowing-out holes 26 on a front face side of the protection cover 23. However, the tip end of each of the electrode needles 4A and 4B may be located at the same position as a front surface of the protection cover 23 or at the position slightly retreated therefrom. Further, a hole diameter of the air-flowing-out hole 26 is formed to be greater than a hole diameter of the air-blowing hole 25.

In the ionizer 1 provided with the construction, when the positive pulsing high-voltage and the negative pulsing high-voltage are alternately applied from the high-voltage-generating device 7 to the positive and negative electrode needles 4A and 4B, respectively, the corona discharge is generated at each of the tip end portions 4*a* and 4*a* of both the electrode needles 4A and 4B, respectively, and the positive and negative ions are alternately generated from both the electrode needles 4A and 4B. Currently, the air from the compressed air source 11 is supplied to the air-blowing outlet 5 through the main flow path 8*a* and the branch flow path 8*b*, and is blown out from the air-blowing outlet 5 into the spatial portion 24.

Figure 5:
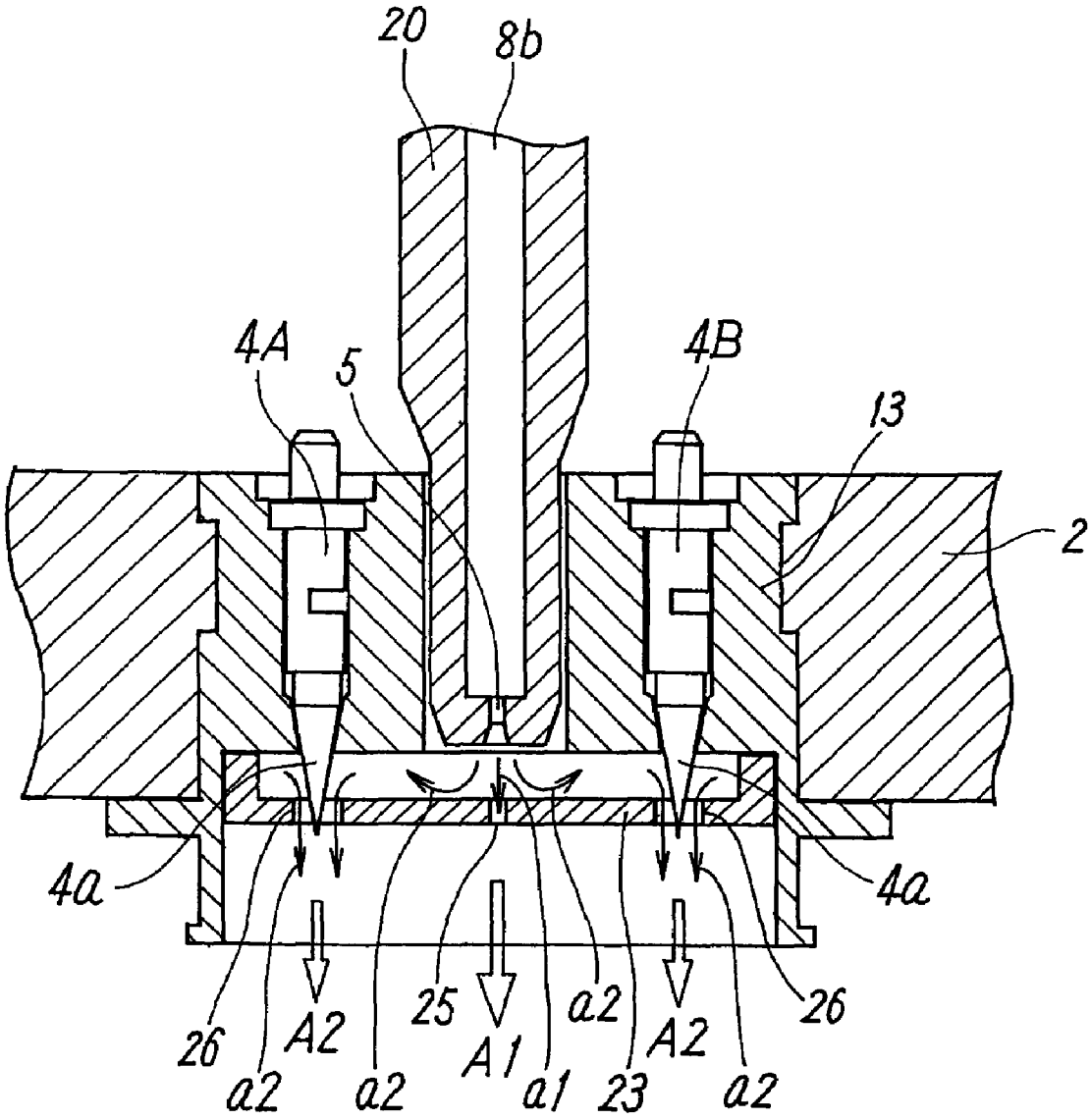
FIG. 5 is a cross-sectional view illustrating a condition of a flow of air at a time of discharge.
Figure 6:
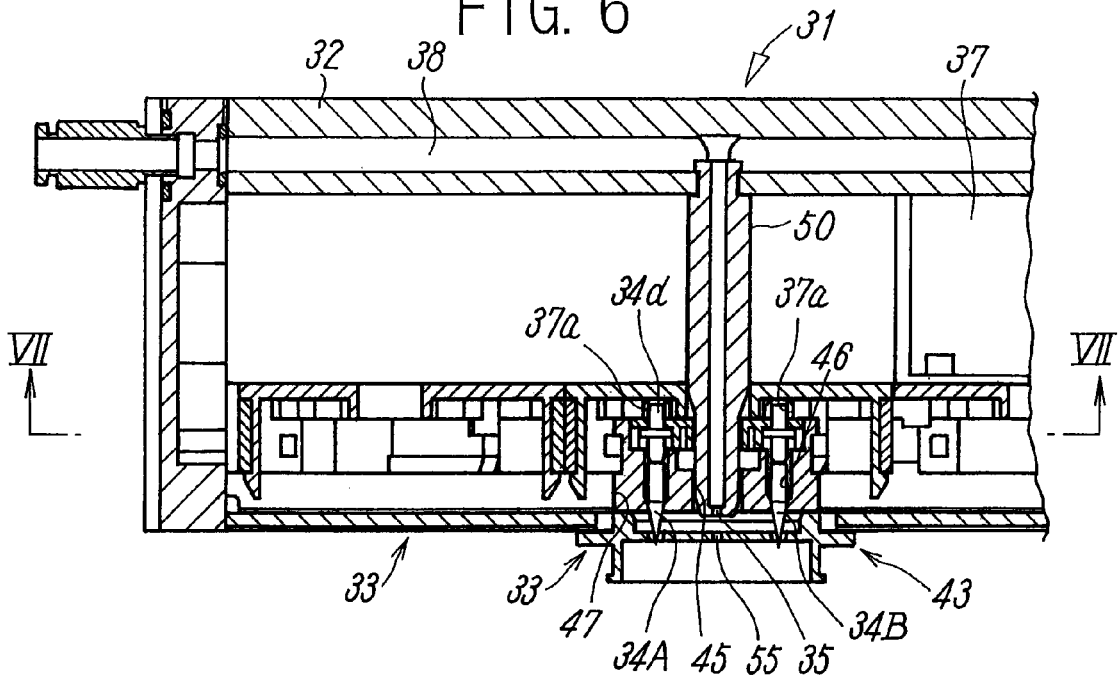
FIG. 6 is a partially enlarged cross-sectional view illustrating the ionizer according to a second embodiment of the present invention at a position corresponding to FIG. 2.

The jet flow of the air vigorously blown out from the air-blowing outlet 5 blows out toward an outside of the protection cover 23, mainly from the air-blowing hole 25 opening in the protection cover 23 at the position just before the air-blowing outlet 5, as indicated by an arrow a1 in FIG. 5, and is blown toward the workpiece serving as a main air flow A1, while approximately keeping the force thereof. Currently, the main air flow A1 becomes ionized air by bringing in the ions generated from the electrode needles 4A and 4B, and the discharging operation for the workpiece W is performed by blowing the ionized air toward the workpiece W.

On the other hand, a part of the air blown out from the air-blowing outlet 5 toward the inner part of the spatial portion 24 is rebounded by the protection cover 23 and diffused in the spatial portion 24, as indicated by an arrow a2 in FIG. 5. Then, the part of the air flows out toward an outside from the air-flowing-out holes 26 respectively surrounding peripheries of the electrode needles 4A and 4B along the tip end portions 4*a* and 4*a* of the respective electrode needles 4A and 4B, and headed for the workpiece serving as auxiliary air flows A2. The auxiliary air flow A2 is ionized as well as the main air flow A1 is.

Although a flow speed of the auxiliary air flow A2 is small compared to a flow speed of the main air flow A1, dust such as dirt or the like existing in the air on a surface of or around the electrode needles 4A and 4B is swept away by that the auxiliary air flow A2 flows along the tip end portions 4*a* of each of the electrode needles 4A and 4B, and thereby the dust is prevented from adhering on the surface of each of the electrode needles 4A and 4B as dirt. As a result, fouling of the electrode needles 4A and 4B due to the adhesion of the dust is lightened and frequency of maintenance such as a cleaning operation, an exchanging operation, and so forth for the electrode needles 4A and 4B is reduced.

In the embodiment, although the housing 2 is provided with a plurality of electrode-attaching portions 3, the electrode-attaching portion 3 may be provided one in number.

Furthermore, although two of the positive and negative electrode needles 4A and 4B, respectively, are disposed along the longitudinal direction of the housing 2 by attaching the electrode cartridge 13 having a long circle in cross-sectional shape to the housing 2 in a condition where the long axis of the long circle is directed in the longitudinal direction of the housing 2, the two of the electrode needles 4A and 4B may be disposed in parallel with each other in a lateral width direction of the housing 2, by attaching the electrode cartridge 13 in a direction perpendicular to the direction, namely in a direction where the long axis of the long circle is directed in the lateral width direction of the housing 2.

Moreover, in the embodiment, although the body portion 23*a* of the protection cover 23 has a flat plate shape, and positioned in a parallel manner in relation to the inner bottom wall 13*a* of the concave portion 14, the body portion 23*a* is not always necessary to have the flat plate shape, but an entire part of or a part of a center thereof may be caved in a conic manner toward an outside (front surface side) thereof. In this case, the air-blowing hole 25 is formed at a position of a top of the cone.

FIG. 6 through FIG. 13 illustrate a second embodiment of an ionizer according to the present invention. A difference of an ionizer 31 in the second embodiment from that in the first embodiment is that an electrode cartridge 43 is constructed by detachably attaching a back plate 43D to a sheath cartridge 43A, which is configured to be detachable from a housing 32, and that electrode needles 34A and 34B are attached to the back plate 43D. Hence, the second embodiment differs from the first embodiment at a point in which even when the electrode needles 34A and 34B get fouled, the dirt can be easily removed. Incidentally, explanation for the part in the construction of the ionizer 31 which is not substantially different from the first embodiment is omitted below, and the point which is different from the above-described first embodiment will be explained below.

As described above, the electrode cartridge 43 to be attached to a plurality of electrode-attaching portions 33 of a housing 32 in the ionizer 31 is composed of the sheath cartridge 43A configured to be detachable from the housing 32, and the back plate 43D, on which the electrode needles 34A and 34B are attached, and detachably attached to the sheath cartridge 43A. The electrode cartridge 43 except the electrode needles 34A and 34B is formed of insulating non-magnetizable material such as synthetic resin or the like. Moreover, the sheath cartridge 43A is constructed by detachably coupling a cartridge body 43B of an upper half and a protection cover 43C of a lower half thereof as is clear from FIG. 9, FIG. 10, and FIG. 13.

The cartridge body 43B has approximately long circle in plane shape similar to the electrode cartridge 13 of the first embodiment, a nozzle-attaching hole 45 is formed at a center thereof, and holding holes 46 for use in the electrode needle are respectively formed at positions at even distances on both sides of the nozzle-attaching hole 45. Further, a pair of guide walls 48*a* having approximately semicircle in cross-section, which are configured to be guides for mounting the later-described back plate 43D, stand upright at both ends of the cartridge body 43B. In front of a portion where the nozzle-attaching hole 45 at a center portion is opened, a projection 48*b* latched with an engaging hole 49*g* of a sandwiching piece 49*e* of the later-described back plate 43D is projected. Further, at front and back inner edges at a lower part of the cartridge body 43B, a latch groove 49*h* for latching a flange portion 53*b* projected to an upper edge at a side portion of the protection cover 43C is provided as is clear from FIG. 9, FIG. 10, and FIG. 13. The flange portion 53*b* is fitted into the latch groove 49*h*, and the protection cover 43C is configured to be mounted by sliding in a long axis direction to the cartridge body 43B having approximately long circle in plane shape.

The protection cover 43C constructing the lower half of the sheath cartridge 43A has an approximately long circle in plane shape similar to the cartridge body 43B, and in the protection cover 43C, the flange portion 53*b* is provided at the upper edge of the side portion thereof, and a concave portion 44 having an approximately long circular shape is formed at a lower surface thereof. Furthermore, when the protection cover 43C is mounted on the cartridge body 43B, a flat-plate-shaped main body portion 53*a* forming a bottom wall of the concave portion 44 is configured to cover both the electrode needles 34A and 34B, and an air-blowing outlet 35 allowed to communicate with an air flow path 38, and to form a spatial portion 54 dispersing the air blown out from the air-blowing outlet 35 between the same and a bottom wall 43*a* of the cartridge body 43B.

In the main body portion 53*a* of the protection cover 43C, an air-blowing hole 55 for blowing the air blown out from the air-blowing outlet 35 toward the workpiece when the protection cover 43C is mounted on a predetermined position of the cartridge body 43B is formed to be positioned in front of the air-blowing outlet 35. In addition, two air-flowing-out holes 56 and 56 for allowing tip end portions 34*a* and 34*a* of the positive and negative electrode needles 34A and 34B to project outward, respectively, and for allowing the air blown out from the air-blowing outlet 35 to flow out toward the outside of the protection cover 43C along these electrode needles 34A and 34B are respectively formed at positions corresponding to the positive and negative electrode needles 34A and 34B. Other configuration of the air-blowing hole 55 and the air-flowing out hole 56 is substantially identical of that in the first embodiment.

Figure 9:
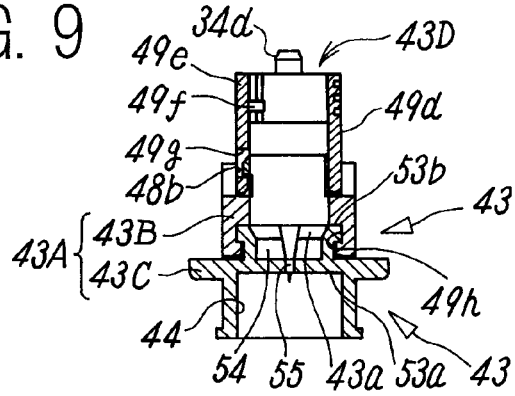
FIG. 9 is a cross-sectional view taken along a line IX-IX in FIG. 8.
Figure 10:
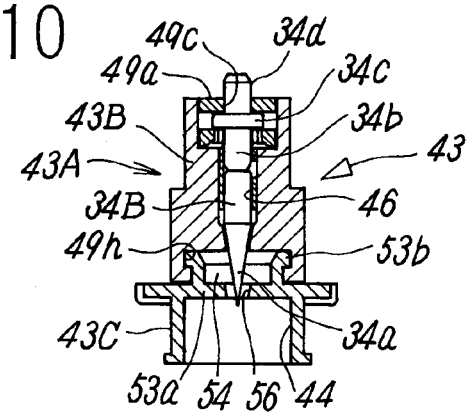
FIG. 10 is a cross-sectional view taken along a line X-X in FIG. 8.
Figure 11:
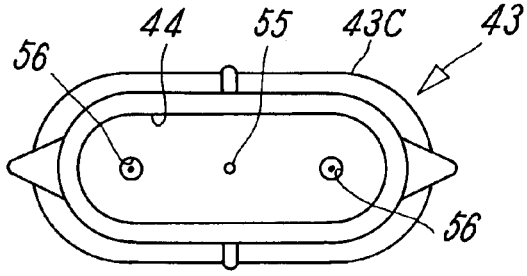
FIG. 11 is a bottom plan view illustrating the electrode cartridge.
Figure 13:
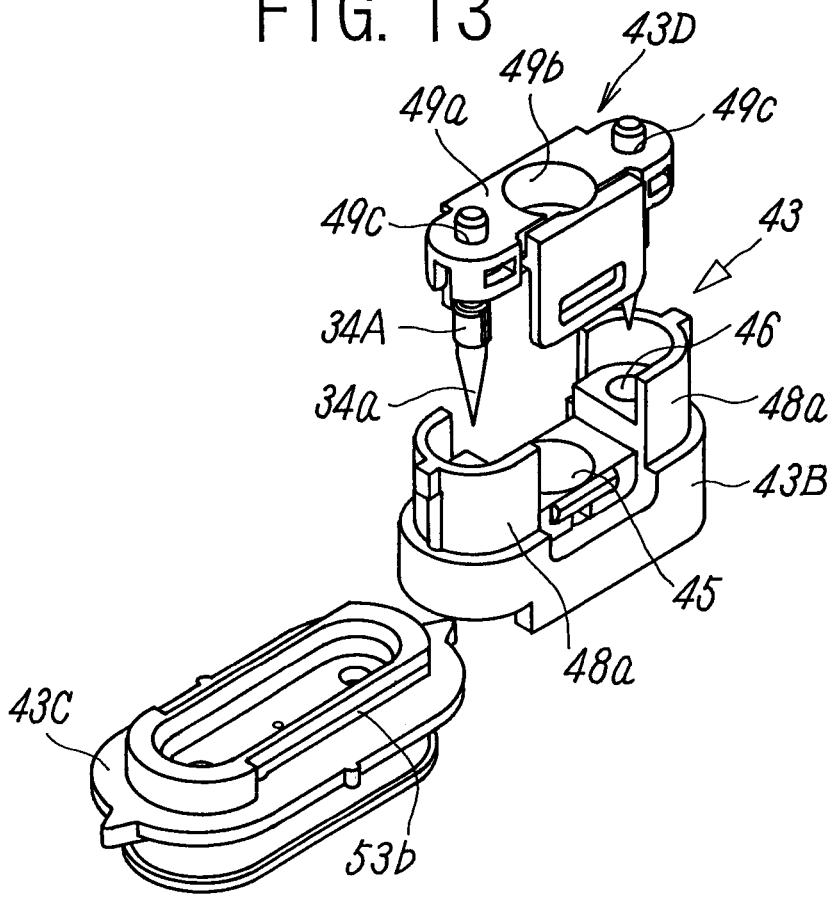
FIG. 13 is a perspective view illustrating the electrode cartridge in an exploded condition.

Moreover, in the back plate 43D, as is clear from FIG. 9, FIG. 13, or the like, a nozzle insertion hole 49*b* is concentrically formed with the nozzle-attaching hole 45 of the cartridge body 43B at a center portion of a plate base board 49*a* to be fitted between the pair of guide walls 48*a* standing upright at both ends of an upper part of the cartridge body 43B. In addition, on both sides of the nozzle insertion hole 49*b*, electrode needle fixing holes 49*c* are respectively formed in a concentric manner with the holding holes 46 for use in the electrode needle of the cartridge body 43B. Further, at a front and back sides of the nozzle insertion hole 49*b* in the plate base board 49*a*, a pair of sandwiching pieces 49*d* and 49*e* for fixing the back plate 43D to the cartridge body 43B by sandwiching a portion, where the nozzle-attaching hole 45 at a center portion of the cartridge body 43B is opened, from outside are provided.

As for these sandwiching pieces 49*d* and 49*e*, one side thereof is constructed as a sandwiching piece 49*d* being in contact with a sandwiching portion of the cartridge body 43B, and the other side thereof is coupled with the plate base board 49*a* of the back plate 43D via a thin-walled elastic deformation portion 49*f*, and is constructed as the sandwiching piece 49*e* for elastically sandwiching the cartridge body 43B by means of elasticity of the elastic deforming piece 49*f*. When the back plate 43D is mounted on the cartridge body 43B, an engaging hole 49*g* provided in the sandwiching piece 49*e* is configured to be latched with the projection 48*b* of the cartridge body 43B. Hence, the back plate 43D is detachably attached to the cartridge body 43B so as to remove the dirt of the electrode needle.

A pair of the electrode needles 34A and 34B to be fixed to the back plate 43D have the same structure as those in the first embodiment, and are provided with base end portions 34*b* for attaching conical tip end portions 34*a*, respectively. In addition, a flange portion 34*c* is provided in the base end portion 34*b*, and a power-distributing portion 34*d* to be electrically connected with a high voltage generating apparatus 37 is provided at an upper end thereof. The electrode needles 34A and 34B are non-rotatably fixed to the back plate 43D by press-fitting the flange portion 34*c* into the electrode needle fixing holes 49*c* of the back plate 43D, or by forming a cross-sectional shape of the base end portion 34*b* for attaching, into a noncircular shape, and fitting the same into the electrode needle fixing holes 49*c* having the same shape. Thereby, when the dirt on the electrode needles 34A and 34B in a condition of being attached to the back plate 43D is removed by means of a cleaning tool formed of felt or the like, lowering of workability of removing the dirt due to rotations of the electrode needles 34A and 34B relative to the back plate 43D is suppressed. It is required for the electrode needles to be detachable from the back plate 43D for exchanging the electrode needles 34A and 34B.

Furthermore, in a condition where the back plate 43D is attached to the cartridge body 43B, respective electrode needles 34A and 34B fixed to the back plate 43D are fitted into the holding holes 46 and 46 for use in the electrode needle in the cartridge body 43, and the tip end portions 34*a* and 34*a* of the electrode needles are formed to be held by the cartridge body 43B in a condition of being projected into the concave portion 44. On the other hand, when the back plate 43D is detached from the cartridge body 43B, the tip end portions 34*a* and 34*a* of the respective electrode needles 34*a* and 34B is configured to be exposed outward so that the dirt is removed by the cleaning operation.

Incidentally, an assembling work for the electrode cartridge 43 is performed such that the back plate 43D is fixed to the cartridge body 43B upon mounting the protection cover 43C on the cartridge body 43B.

Figure 7:
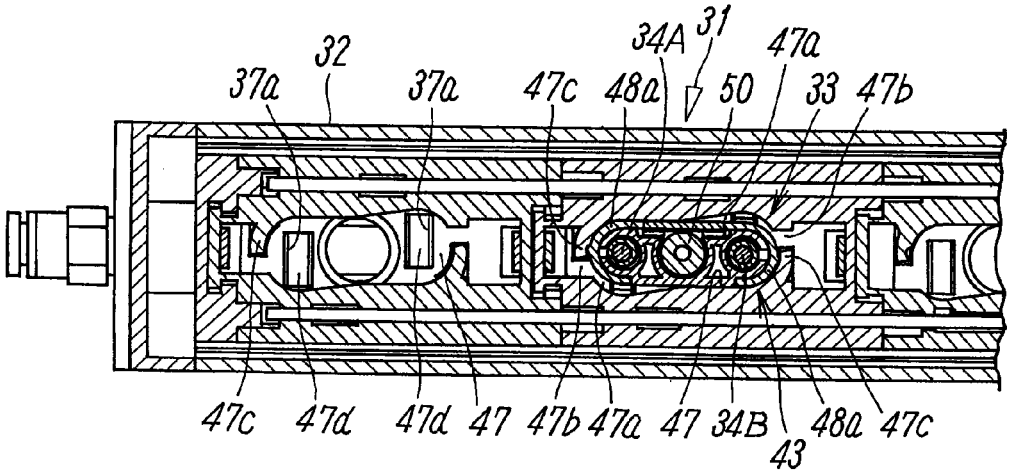
FIG. 7 is a partially enlarged cross-sectional view taken along a line VII-VII in FIG. 6.

The electrode cartridges 43 are detachably fitted and fixed in a plurality of long circular electrode attaching holes 47, which are formed at a lower surface of the housing 32 at even distances from below the housing 32. The electrode attaching hole 47 formed in the housing 32 for the fixing operation has a long circular shape corresponding to a plane shape of the electrode cartridge 43, as illustrated in FIG. 7. In addition, the electrode cartridge 43 is formed to have a plane shape provided with a room 47*a* where the electrode cartridge 43 fitted into the electrode-attaching hole 47 is able to be slanted in the electrode-attaching hole 47. Furthermore, a latch mechanism is provided in the electrode cartridge 43 and the electrode-attaching hole 47. The latch mechanism is that the electrode cartridge 43 latches and fixes into the electrode-attaching hole 47 when the electrode cartridge is in the normally attached state after fitting the electrode cartridge into the electrode-attaching hole at a position of the room 47*a*. On the other hand, the latch mechanism allows the electrode cartridge 43 to remove from the electrode-attaching hole in a condition that the electrode cartridge 43 slants within the room 47*a*.

Figure 8:
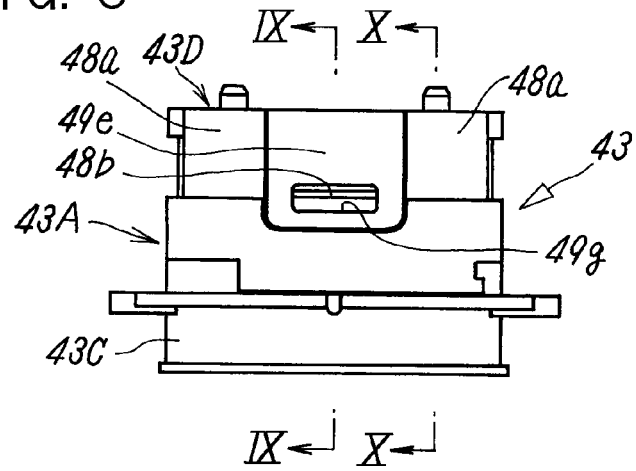
FIG. 8 is a front elevation illustrating an electrode cartridge.
Figure 12:
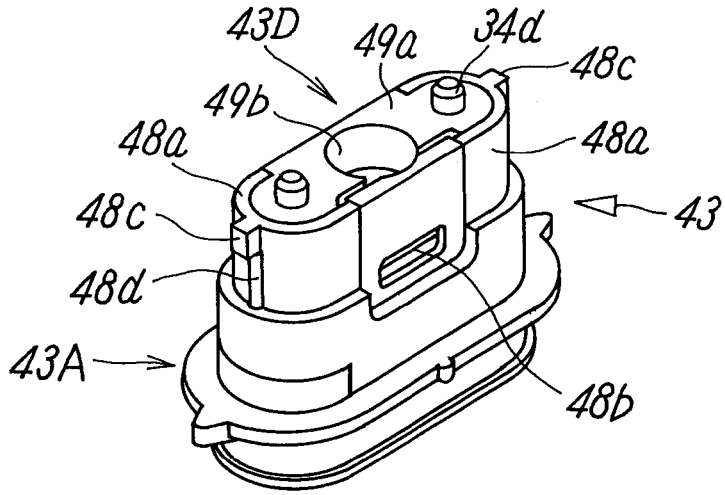
FIG. 12 is a perspective view illustrating the electrode cartridge.

In the latch mechanism, in the guide wall 48*a* in the cartridge body 43B of the electrode cartridge 43, as is clear from FIG. 8, FIG. 12, and FIG. 13, a latch projection 48*c* at an upper part and a friction ridge 48*d* below the same having a smaller projecting height than that of the latch projection 48*c* are provided. On the other hand, at both end portions in a longitudinal direction of the electrode-attaching hole 47, side grooves 47*b* that allow the latch projection 48*c* to pass when the electrode cartridge 43 is fitted into the electrode-attaching hole 47 in a condition of being slanted within the room 47*a* are provided. In addition, adjoining the side grooves 47*b*, elastic contacting pieces 47*c* that are elastically in contact with the friction ridges 48*d* at an outer surface of the guide walls 48*a* at both ends of the cartridge body 43B when the electrode cartridge 43 is returned to a normally attached state along a longitudinal direction of the housing 32 after the electrode cartridge 43 is fitted into the electrode-attaching hole 47 are provided.

The elastic contacting piece 47*c* is configured to hold the electrode cartridge 43 while being elastically in contact with the friction ridge 48*d* resulting from that the electrode cartridge 43 is pressed by means of the friction ridge 48*d* at the outer surface of the guide wall 48*a* at both ends of the cartridge body 43B, when the electrode cartridge 43 in a slanted state is returned to the normally attached state by rotating the same around a center thereof. Therefore, the elastic contacting pieces 47*c* at both ends of the electrode-attaching hole 47 are formed in a manner so as to face in opposite directions to each other facing the tip ends thereof to the side grooves 47*b* side. Further, the elastic contacting pieces 47*c* at both ends of the electrode-attaching hole 47 are positioned at lower parts of the latch projections 48*c* at both ends of the cartridge body 43B being returned to the normally attached state, and latched to the latch projections 48*c*. Thus, the elastic contacting pieces 47*c* is provided with a function to suppress a dropping off operation of the electrode cartridge 43.

Furthermore, the cartridge 43 is mounted in the electrode-attaching hole 47 and at the same time, the electrode needles 34A and 34B are configured to be respectively connected to the positive and negative high voltage generating circuits in the high voltage generating apparatus 37. For that, terminal grooves 47*d* for housing connecting terminals 37*a* that are electrically connected to the respective high voltage generating circuits at positions corresponding to the respective electrode needles 34A and 34B at an inner bottom of the electrode-attaching hole 47, within the area where the state of the electrode cartridge 43 can be slanted when the same is attached/detached are provided. When the electrode cartridge 43 is fitted into the electrode-attaching hole 47, the positive and negative high voltages are configured to be applied to both the electrode needles 34A and 34B regardless of whether the electrode cartridge 43 is slanted or not by fitting the power-distributing portions 34*d* at the electrode needles 34A and 34B into the respective terminal grooves 47*d*.

Hence, when the electrode cartridge 43 is mounted in the electrode-attaching hole 47, the electrode cartridge 43 is rotated around a center axis upon fitting the electrode cartridge 43 into the electrode-attaching hole 47 in a condition of being slanted to the longitudinal direction of the housing 32, and is formed to be in the normally attached state facing the longitudinal direction. Thereby, the latch projections 48*c* at both ends of the cartridge body 43B come to positions on the elastic contacting pieces 47*c* at both ends of the electrode-attaching hole 47, and are latched to the elastic contacting pieces 47*c*. This results in preventing the electrode cartridge 43 from being dropped off. When the electrode cartridge 43 is attached to the electrode attaching hole 47, a nozzle member 50 provided with the air-blowing outlet 35 at the tip end thereof is inserted into the nozzle insertion hole 49*b* in the back plate 43D and the nozzle-attaching hole 45 in the cartridge body 43B. Then, the air is blown out from the air-blowing outlet 35 to the spatial portion 54 via the nozzle member 50.

On the other hand, when the electrode cartridge 43 is detached from the electrode-attaching hole 47, if the electrode cartridge 43 is slanted to the longitudinal direction of the housing 32 by rotating the same in the electrode-attaching hole 47, the latch projections 48*c* at both ends of the cartridge body 43B are removed from the elastic contacting pieces 47*c* at both ends of the electrode-attaching hole 47. Thereby, it becomes possible to detach the electrode cartridge 43.

The invention claimed is:

1. An ionizer comprising:

a housing including one or more electrode-attaching portions;

a positive electrode needle and a negative electrode needle disposed in the electrode-attaching portions, respectively, in parallel with each other for generating an ion;

an air-blowing outlet being open in the electrode-attaching portion at a position between the positive electrode needle and negative electrode needle;

a protection cover for covering both the positive electrode needle and negative electrode needle, and the air-blowing outlet; and a spatial portion spreading inside the protection cover-across both of the positive electrode needle and negative electrode needle, and the air-blowing outlet, wherein the protection cover comprises an air-blowing hole, and two air-flowing-out holes, and wherein the air-blowing hole-is positioned in front of the air-blowing outlet for blowing air blown out from the air-blowing outlet toward a workpiece, and the air-flowing-out holes are respectively formed at positions corresponding to the positive electrode needle and negative electrode needle, and allow the air blown out from the air-flowing outlet and diffused in the spatial portion, to flow out to an outside of the protection cover along the positive electrode needle and negative electrode needle, respectively.

2. The ionizer according to claim 1, wherein the positive electrode needle and negative electrode needle are attached to an electrode cartridge, and the positive electrode needle and negative electrode needle are attached to the electrode-attaching portion of the housing via the electrode cartridge, and wherein the electrode cartridge includes a concave portion encompassing the tip end portion of each of the positive electrode needle and negative electrode needle, and wherein the air-blowing outlet is opened in the concave portion and the protection cover is disposed in a manner so as to cover the air-blowing outlet and both the positive electrode needle and negative electrode needle.

3. The ionizer according to claim 2, wherein the air-blowing hole is concentrically positioned with the air-blowing outlet, and the air-flowing-out hole is concentrically positioned with the positive electrode needle and negative electrode needle.

4. The ionizer according to claim 3, wherein an acute tip end portion of each of the positive electrode needle and negative electrode needle projects out from the air-flowing-out hole in front of the protection cover.

5. The ionizer according to claim 2 or 3, wherein a hole diameter of the air-blowing hole is smaller than a hole diameter of the air-flowing-out hole.

6. The ionizer according to claim 2, wherein the electrode cartridge is constructed by detachably attaching a back plate provided with the positive electrode needle and the negative electrode needle to a sheath cartridge being detachable to the housing, and wherein the concave portion is formed in the sheath cartridge, and wherein a tip end portion of the electrode needle attached to the back plate is projected to the concave portion through a holding hole for use in the electrode needle in the sheath cartridge.

7. The ionizer according to claim 6, wherein the electrode needle is non-rotatably and detachably mounted on the back plate.

8. The ionizer according to claim 6, wherein the sheath cartridge is composed of a cartridge body having an approximately long circle in plane shape, and a protection cover having the same shape, and detachably coupled by sliding in a longitudinal direction thereof while engaging a flange portion and a latch groove thereof.

9. The ionizer according to claim 6, wherein the air-blowing outlet is formed in a nozzle member and the nozzle member is inserted into a center of the electrode cartridge having a long circle in plane shape.

10. The ionizer according to claim 9, wherein the back plate is provided with a pair of sandwiching pieces for fixing the back plate to the sheath cartridge by sandwiching the sheath cartridge, and wherein at least one of the sandwiching pieces is constructed to elastically sandwich the sheath cartridge by means of elasticity of a thin-walled elastic deformation portion.

11. The ionizer according to claim 9, wherein an electrode-attaching hole for attaching the electrode cartridge, to be provided in the housing, corresponds to a plane shape of the electrode cartridge, and is formed to have a plane shape including a room where the electrode cartridge fitted into the electrode-attaching hole can be slanted around the nozzle member in the electrode-attaching hole, and a latch mechanism is provided in the electrode cartridge (43) and the electrode-attaching hole (47), the latch mechanism is that the electrode cartridge (43) latches and fixes into the electrode-attaching hole (47) when the electrode cartridge is in the normally attached state after fitting the electrode cartridge into the electrode-attaching hole at a position of the room (47*a*), and the latch mechanism allows the electrode cartridge (43) to remove from the electrode-attaching hole in a condition that the electrode cartridge (43) slants within the room (47*a*).

12. The ionizer according to claim 11, wherein in the latch mechanism, a latch projection at an upper part, and a friction ridge having a smaller projecting height than the latch projection at a lower part, are provided at both ends in a longitudinal direction of the electrode cartridge, and wherein side grooves that pass the latch projection when the electrode cartridge is fitted into the electrode-attaching hole in a slanted condition within the room are provided at both end portions in a longitudinal direction of the electrode-attaching hole, and wherein, adjoining the side groove, an elastic contacting piece that elastically comes in contact with the friction ridge when the electrode cartridge is returned to a normally attached state along a longitudinal direction of the housing after fitting the same into the electrode attaching hole, is provided, and wherein the elastic contacting piece is constructed as that elastically comes in contact with the friction ridge by that the electrode cartridge is pressed by the friction ridge when the electrode cartridge being in a slanted state is returned to the normally attached state while rotating the same, and wherein both the elastic contacting pieces suppress a dropping-off operation of the electrode cartridge by means of being latched with the latch projection while being positioned at a lower part of the latch projection at both ends of the electrode cartridge being returned to the normally attached state, and wherein the electrode cartridge is thereby detachably fixed.

13. The ionizer according to claim 11, wherein a connecting terminal connected to a positive and negative high voltage generating circuit in a high voltage generating apparatus in the housing is provided at the electrode-attaching portion of the housing where the electrode cartridge is attached, and wherein the connecting terminals are provided at positions corresponding to the electrode needles of the electrode cartridge to be mounted on the electrode-attaching portion.

* * * * *